US006810206B1

(12) United States Patent
Clark, Jr.

(10) Patent No.: US 6,810,206 B1
(45) Date of Patent: Oct. 26, 2004

(54) DRAIN PLUG HEATER

(75) Inventor: Benjamin T. Clark, Jr., South Bend, IN (US)

(73) Assignee: Farm Innovators, Inc., Plymouth, IN (US)

( * ) Notice: Subject to any disclaimer, the term of this patent is extended or adjusted under 35 U.S.C. 154(b) by 110 days.

(21) Appl. No.: 10/252,221

(22) Filed: Sep. 23, 2002

Related U.S. Application Data

(60) Provisional application No. 60/323,857, filed on Sep. 21, 2001.

(51) Int. Cl.[7] ..... F24H 9/12

(52) U.S. Cl. ..... 392/501; 392/448; 392/453

(58) Field of Search ..... 392/507, 441, 392/448, 453

(56) References Cited

U.S. PATENT DOCUMENTS 6,151,448 A * 11/2000 Reusche et al. ..... 392/501

OTHER PUBLICATIONS

NEMA specs for 3 Conductor Molded Straight Plugs –Standard Version. taken from American Cordset Industries web page (americancordsets.com, 1999.*

Farm Innovators, Inc.; product brochure dated 1997; U.S.A.

Panel Components Corporation; cord specification for Part #70401020091.

* cited by examiner

*Primary Examiner*—Thor Campbell
(74) *Attorney, Agent, or Firm*—Barnes & Thornburg

(57) ABSTRACT

A water heater has a housing, a heating element, and an electric power cord secured to the housing and to a three-pronged plug configured for insertion into a standard electrical power outlet. The power cord is continuous from the housing to the three-pronged plug. A portion of the housing has a diameter which is less than approximately one inch and is configured to extend through a drain plug opening in the tank for securing the housing to the tank. The plug has a diameter which is substantially equal to, or less than, the diameter of that portion of the housing.

10 Claims, 5 Drawing Sheets

DRAIN PLUG HEATER

RELATED APPLICATIONS

The present application is related to and claims priority to U.S. Provisional Patent Application, Ser. No. 60/323,857, filed on Sep. 21, 2001, entitled Drain Plug Heater. The subject matter disclosed in that provisional application is hereby expressly incorporated into the present application.

FIELD OF THE INVENTION

This invention relates generally to heaters for water tanks, and more particularly to a heater for installation in the drain plug opening of a water tank.

BACKGROUND OF THE INVENTION

Commercially available water tanks typically include a drain opening in their side to drain the tank so that it can be moved or refilled. The sizes of the drain plug openings vary depending on the manufacturer of the tank. Currently available are heaters that can be used in tanks with drain openings greater than 1.75 inches in diameter, such as the DPH-15 manufactured by the assignee of this patent application. A drain opening of this size permits the passing through of the electrical plug. However, many tanks have drain openings smaller than 1.75 inches which do not allow the passage of the standard sized electrical plug. U.S. Pat. No. 6,151,448 shows a device that can be used in water tanks with smaller drain openings. This device includes an intermediate connector having a small diameter located in the power cord between the heater body and the electrical plug. When the heater is installed in the drain opening of a tank, the electrical plug is disconnected from the heater body by disconnecting the intermediate connector. One end of the intermediate connector is then passed through the drain opening and the electrical plug is reconnected by connecting the other end of the intermediate connector to the end of the intermediate connector passed through the drain opening. Therefore, the electrical plug can have a larger dimension than the drain opening. The intermediate connector, however, increases the problems of short circuiting or electrical shock, particularly when the connector is exposed to water, increases the possibility of accidental disconnection, and increases the cost of the device.

SUMMARY OF THE INVENTION

The present invention provides a drain plug heater. One embodiment of the drain plug heater includes a heating element, a housing, and a power cord. The housing includes a mounting portion adapted to be inserted into a drain opening of varying sizes. The power cord includes a reduced sized three-prong electrical plug that will pass through drain openings of varying sizes including openings less than one inch in diameter.

In one embodiment, a water heater for installation in a drain plug opening of a water tank comprises a housing, a heating element extending into the housing, and an electrical power cord. A proximal end of the power cord is secured to the housing and a distal end of the cord is secured to a three-prong plug configured for insertion into a standard electrical power outlet. The cord is formed of at least three conductive lines extending continuously from the housing to the three-pronged plug. A portion of the housing has a diameter of less than approximately one inch and is configured to extend through the drain plug opening for use in securing the housing to the water tank. The three-pronged plug has a diameter which is substantially equal to, or less than, the diameter of that portion of the housing.

In one embodiment, the housing comprises a cupped portion. In this embodiment the heating element extends from the cupped portion into the water tank.

In one embodiment, the portion of the housing configured to extend through the drain plug opening has a diameter of approximately ⅞ inch. In this embodiment, the diameter of the three-pronged plug is substantially equal to the diameter of that portion of the housing (i.e., the diameter of the three-pronged plug is approximately ⅞ inch).

In one embodiment, the portion of the housing configured to extend through the drain plug opening is threaded. In this embodiment, a nut is provided for securing the housing to the water tank. The nut is threaded to engage the portion of the housing which extends through the drain plug opening. The nut is further configured to allow for passage of the three-pronged plug through a central opening of the nut.

In one alternative embodiment, the central opening of the nut is configured to engage the portion of the housing which extends through the drain plug. In this embodiment, the central opening is provided with at least one notch to facilitate passage of the three-pronged plug through the opening. In an alternative embodiment, the central opening of the nut is provided with at least one projection extending into the central opening. In this embodiment, the projection engages threads or other structures on the housing portion to secure the housing to the water tank.

In certain embodiments of the invention, the nut configured to engage the housing to secure the housing to the tank has a continuous circumferentially-extending body. In certain embodiments, the nut has a central opening which has a diameter slightly larger than the diameter of the three-pronged plug.

BRIEF DESCRIPTION OF THE DRAWINGS

The present invention will be described hereafter with reference to the attached drawings which are given as a non-limiting example only, in which:

FIG. 4 is a plan view showing alternative fasteners (nuts) for use with the drain plug heater of FIG. 1. Specifically.

Figure 1:
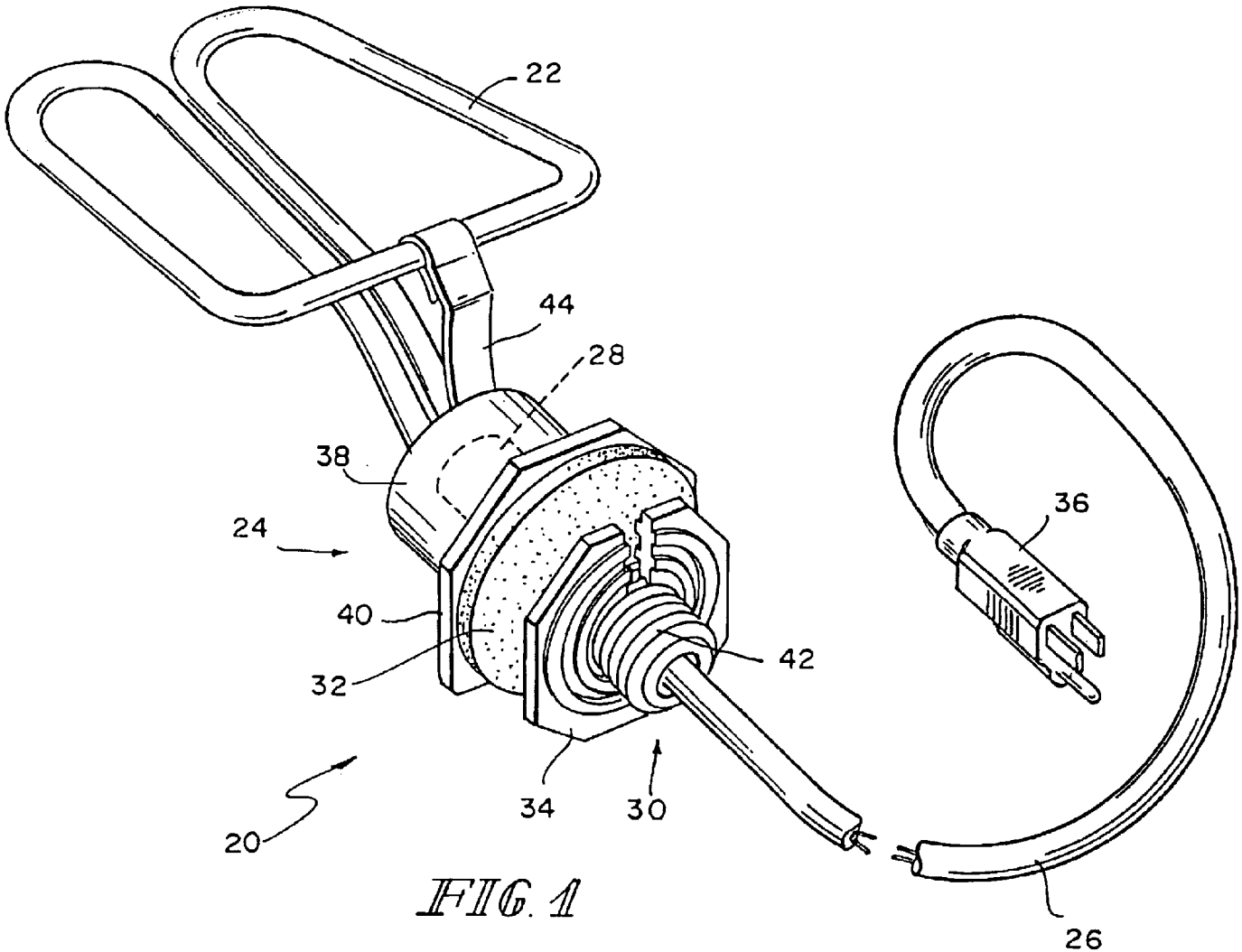
FIG. 1 is a perspective view of a drain plug heater according to the present invention.
Figure 2:
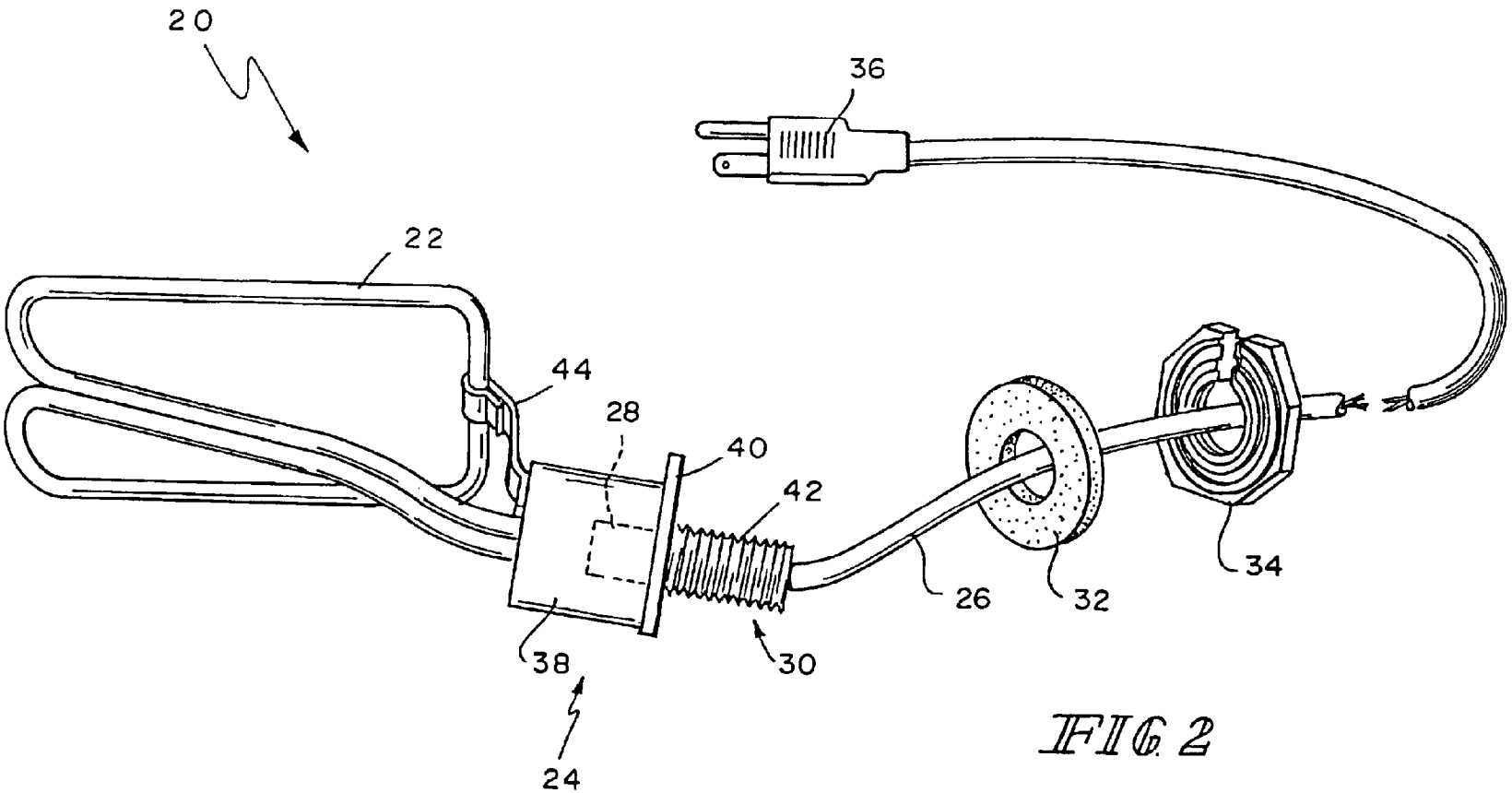
FIG. 2 is a perspective view of the drain plug heater of FIG. 1 with the washer and slotted nut removed from the housing portion.

The exemplification set out herein illustrates an embodiment of the invention that is not to be construed as limiting the scope of the invention in any manner.

DESCRIPTION OF EMBODIMENTS OF THE INVENTION

The embodiment described herein is not intended to be exhaustive or to limit the invention to the precise form disclosed.

Referring to FIGS. 1 through 5, an embodiment of an electric heater, generally referenced as 20, for a water tank in accordance with the present invention includes a heating element 22, a housing 24, and a power cord 26. Heating element 22 extends from housing 24 for heating the contents of the tank. Housing 24 includes a temperature control device 28 and a mounting portion 30 configured to mount to the drain plug opening of the tank with power cord 26 extending from mounting portion 30 of housing 24.

Power cord 26 extends from housing 24 and includes a three-prong electrical plug 36 at the distal end for insertion into a standard electrical power outlet. The proximal end of power cord 26 is electrically connected to heating element 22 and temperature control device 28. Power cord 26 includes three conductive lines with each of the lines connected to one of the prongs of electrical plug 36.

Heating element 22 is an elongated tubular member with its first and second ends extending into housing 24. Within housing 24, the first end of heating element 22 is connected to one of the lines of power cord 26, and the second end is connected to temperature control device 28.

Temperature control device 28 is a thermostat or a temperature responsive switch which removes power from heating element 22 when heating element 22 reaches a predetermined temperature. Temperature control device 22 is electrically connected between one of the lines of power cord 26 and the second end of heating element 22. Thermally connected to temperature control device 28 is a thermally conductive strap 44 which extends from housing 24 and is physically connected to heating element 22.

Housing 24 includes a cup portion 38, a sealing wall 40, and a threaded portion 42. Power cord 26 extends through threaded portion 42 into cup portion 38. Temperature control device 28 and the ends of heating element 22 are disposed within cup portion 38 and are appropriately electrically connected. Cup portion 38 containing an end of power cord 26, temperature control device 28, and the ends of heating element 22 is hermetically sealed by filling with a suitable waterproof sealant.

Threaded portion 42 of housing 24 is adapted to extend through the drain plug opening of the water tank to allow electric heater 20 to be mounted to the water tank using a washer 32 and, in one embodiment, a slotted nut 34. The diameter of threaded portion 42 is approximately ⅞ inch allowing it to be inserted into the drain plug opening of most water tanks. When threaded portion 42 is fed through the drain plug opening, washer 32 is between the inner wall of the water tank and sealing wall 40 of heater 20. When slotted nut 34 is tightened to the outer wall of the water tank on threaded portion 42, washer 32 creates a watertight seal between sealing wall 40 and the inner wall of the water tank.

Three-prong electrical plug 36 is smaller in size than the typical three-prong electrical plug. The diameter of an opening in which three-prong electrical plug 36 would pass through is approximately the same diameter as threaded portion 42, allowing heater 20 to be used in tanks having a variety of sizes of drain plug openings. The diameter of the opening for plug 36 is approximately ⅞ inch as opposed to the diameter of an opening required for a standard three-prong plug which would be greater than one inch. Using the reduced-sized plug eliminates the need for an intermediate connector, eliminating the additional cost and potential for disconnection, short circuiting, or electrical shock due to using an intermediate connector.

Figure 3:
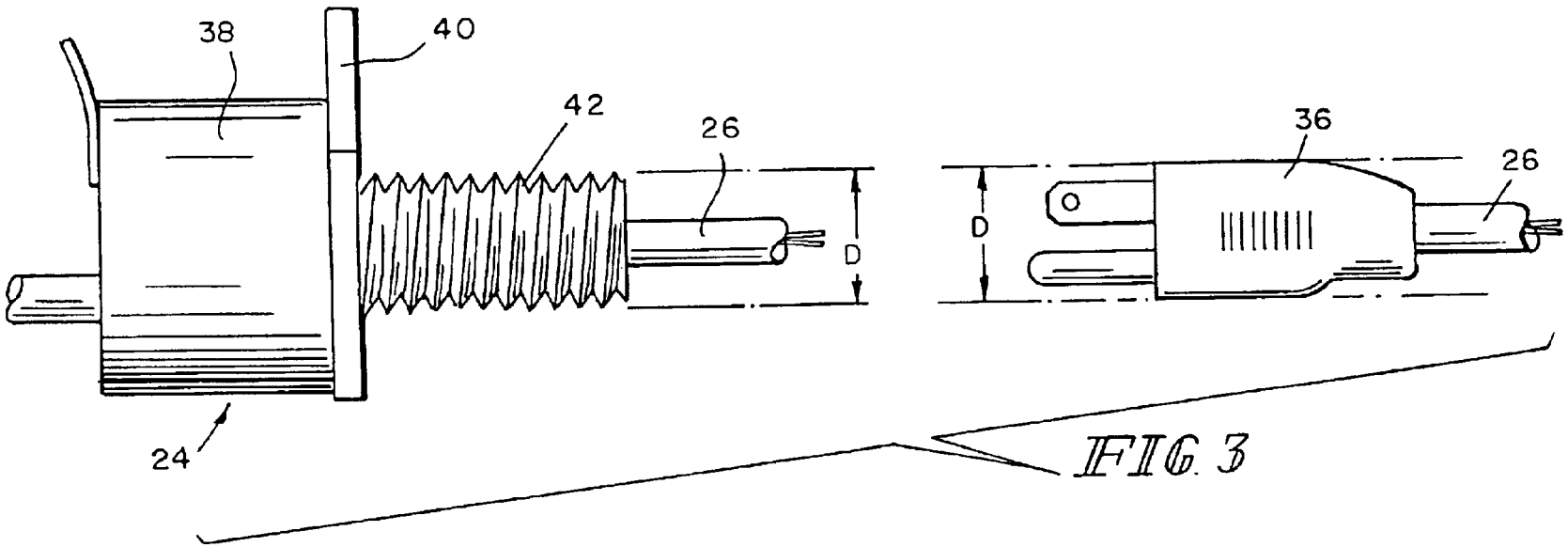
FIG. 3 is a close-up view of the electrical plug and housing of the drain plug heater of FIG. 1.

As illustrated by FIG. 3, in an exemplary embodiment the overall diameter D of threaded portion 42 of housing 24 is approximately equal to the overall diameter of three-prong plug 36. The smallest drain plug opening in which the heater of the present invention is intended to be installed is slightly less than 1 inch. The diameter of one such opening was measured to be 0.923 inch. Thus, the overall diameter D is preferably less than, or at least equal to, this diameter.

While it might be considered desirable to make the overall diameter D well-smaller than the smallest diameter drain plug opening of interest, such is neither possible or desirable. In addition to being dimensioned to mate with a standard female electrical outlet, three-prong electrical plug 36 must meet the requirements of UL Standard No. 817. That standard includes a prong retention test and an elevated heat test. Thus, it is impractical to indiscriminately reduce the amount of material forming plug 36 for the sole purpose of reducing the overall diameter D. In one embodiment of the invention, the overall diameter D of plug 36 is approximately ⅞ inch (0.875 inch). A plug having this approximate overall diameter has been tested and meets UL Standard No. 817.

In certain embodiments, there is an additional factor which bears on the overall diameter D of three-prong electrical plug 36. That factor is the inside diameter of nut 34. The embodiment pictured in FIGS. 1 and 2 employs a slotted nut 34. The slot allows for passage of cord 26 so that nut 34 can be slipped over cord 26 and threaded onto threaded portion 42. In this way, passage of plug 36 through the central opening of nut 34 is not required.

Figure 4A:
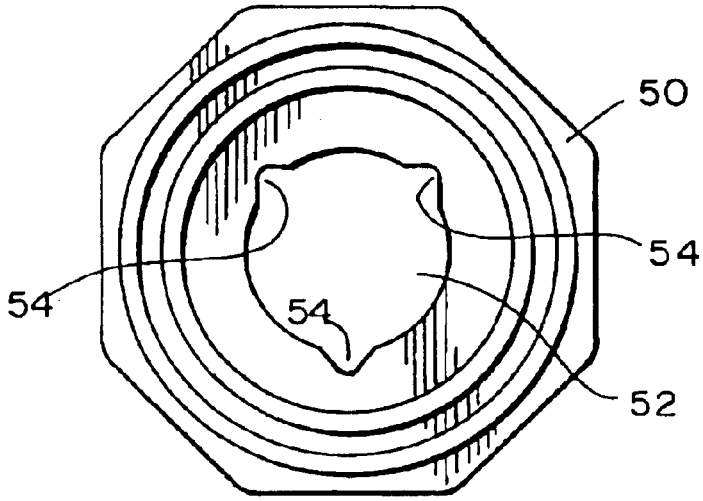
FIG. 4*a* shows a nut having a circumferentially-continuous body and a plurality of notches in a central opening thereof.

In alternative embodiments, a solid (i.e., non-slotted) nut having a continuous outer diameter may be desirable. FIG. 4 illustrates at least two such alternatives. FIG. 4*a* shows a nut 50 having a continuous circumferentially-extending body, and a central opening 52. Opening 52 is threaded to allow for engagement with threaded portion 42 of housing 24. A plurality of notches 54, are provided in the walls of the threaded opening 52. In the example illustrated in FIG. 4*a*, three notches are provided. A greater or lesser number of notches may be provided in other embodiments. The presence of notches 54 does not disrupt the pattern of threads and, thus, the ability of nut 50 to engage threaded portion 42 of housing 24. However, the notches do allow additional clearance for portions of plug 36 to pass through central opening 52. The particular shape(s) of the notches may vary.

Figure 4B:
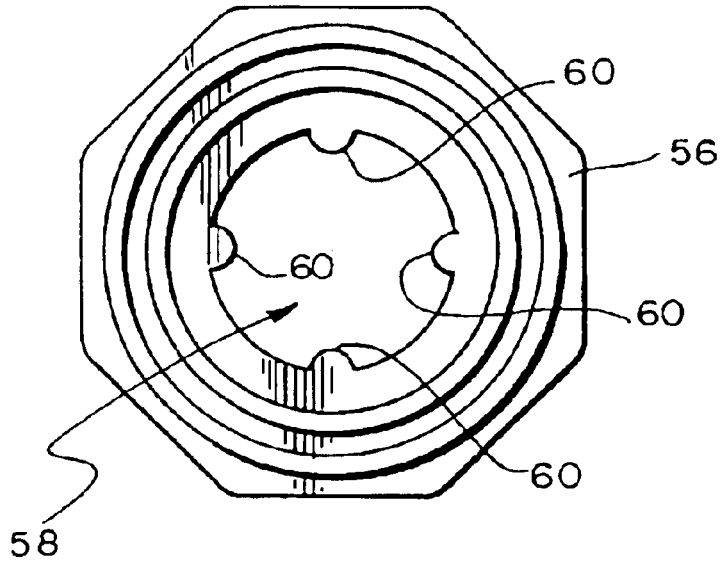
FIG. 4*b* shows a nut having a circumferentially-continuous body and a plurality of projections extending into a central opening thereof.
Figure 5:
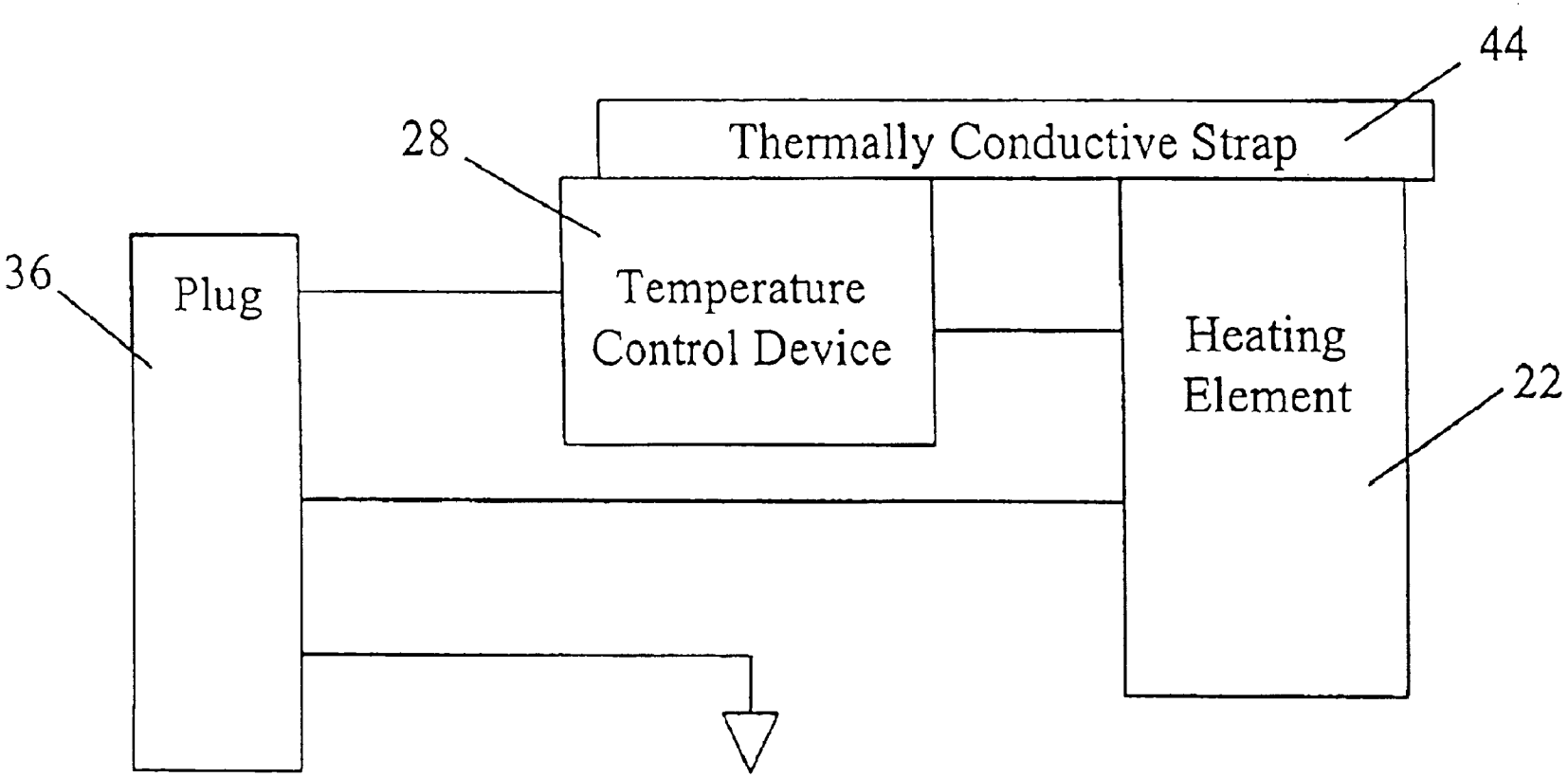
FIG. 5 is a block diagram of the drain plug heater of FIG. 1.

FIG. 4*b* shows an alternative embodiment in the form of nut 56. Like nut 50, nut 56 has a circumferentially-continuous, solid body. Nut 56 also has a central opening 58 which is larger than the central opening of nut 52. A plurality of projections 60 (in this example, 4) extend from the body of nut 56 inwardly into opening 58. Projections 60 are sized and positioned so as to engage the threads of threaded portion 42 of housing 24. A greater or fewer number of projections may be provided. However, the projections are preferably symmetrically spaced around the inner periphery of opening 58 to evenly distribute stress to nut 56. Projections 60 may also be formed so as to engage slots or other alternative fastening structures formed in portion 42 of housing 24.

An additional alternative to slotted nut 34 which is not pictured in the drawings involves forming plug 36 with the smallest possible diameter sufficient to pass UL Standard No. 817. Portion 42 of housing 24, and the corresponding opening of a nut intended to engage portion 42, are made as large as possible. Indeed, the "peaks" of the female threads in the opening of the nut may be machined away, while leaving sufficient material to engage the male threads on threaded portion 42. At present, it is thought that the lower limit of plug diameter is approximately 0.872 inch. Thus, an inside diameter for the opening through a nut of slightly larger dimension will allow a plug having an overall diameter near this lower limit to pass. Such alternatives are considered within the scope of the present invention.

While this invention has been described as having an exemplary embodiment, this application is intended to cover any variations, uses, or adaptions using its general principles. Further, this application is intended to cover such departures from the present disclosure as come within the known or customary practice within the art to which it pertains.

What is claimed is:

1. A water heater for installation in a drain plug opening of a water tank, comprising:

a housing;

a heating element extending into the housing; and an electric power cord having a proximal end secured to the housing and a distal end secured to a three-prong plug configured for insertion into a standard electrical power outlet, said power cord being formed of at least three conductive lines extending continuously from the housing to the three-prong plug;

wherein a portion of said housing has a diameter of less than approximately one inch and is configured to extend through the drain plug opening for securing the housing to the tank; and wherein said three-prong plug has a diameter of one inch or less and is configured to extend through the drain plug opening.

2. The water heater of claim 1, wherein said housing comprises a cup portion and wherein said heating element extends from the cup portion into the water tank.

3. The water heater of claim 1, wherein the portion of the housing configured to extend through the drain plug opening has a diameter of approximately ⅞ inch, and wherein said diameter of the three-prong plug is substantially equal to the diameter of said portion of the housing.

4. The water heater of claim 1, wherein the portion of the housing configured to extend through the drain plug opening is threaded, and further comprising a nut for securing the housing to the water tank.

5. The water heater of claim 4, wherein said nut is configured to threadingly engage the portion of the housing configured to extend through the drain plug opening, and is configured to allow passage of the three-prong plug therethrough.

6. The water heater of claim 4, wherein a central opening of the nut is configured to engage said portion of the housing, and wherein said central opening is provided with at least one notch to facilitate passage of the three-prong plug therethrough.

7. The water heater of claim 4, wherein a central opening of the nut is configured to engage said portion of the housing, and wherein said central opening is provided with at least one projection extending into the central opening.

8. The water heater of claim 1, further comprising a nut configured to engage said portion of the housing to secure the housing to the tank, said nut having a continuous circumferentially-extending body.

9. The water heater of claim 8, wherein the nut has a central opening having a diameter slightly larger than the diameter of the three-prong plug.

10. A water heater for installation in a drain plug opening of a water tank, comprising:

a housing;

a heating element extending into the housing; and an electric power cord having a proximal end secured to the housing and a distal end secured to a three-prong plug configured for insertion into a standard electrical power outlet, said power cord being formed of at least three conductive lines extending continuously from the housing to the three-prong plug;

wherein a portion of said housing has a diameter of less than approximately one inch and is configured to extend through the drain plug opening for securing the housing to the tank; and wherein said three-prong plug is configured to extend through a drain plug opening of one inch or less.

* * * * *